United States Patent [19]

Council, Jr.

[11] Patent Number: 4,947,715

[45] **Date of Patent: * Aug. 14, 1990**

[54] METHOD AND APPARATUS FOR CUTTING AN ASPHERIC SURFACE ON A WORKPIECE

[75] Inventor: Buford W. Council, Jr., Ruskin, Fla.

[73] Assignee: Citycrown, Inc., Tampa, Fla.

[ * ] Notice: The portion of the term of this patent subsequent to Dec. 5, 2006 has been disclaimed.

[21] Appl. No.: 410,148

[22] Filed: Sep. 20, 1989

Related U.S. Application Data

[62] Division of Ser. No. 276,230, Nov. 22, 1988.

[51] Int. Cl.[5] ..... B23B 5/36; B23B 1/00

[52] U.S. Cl. ..... 82/1.11; 51/124 L; 51/165.71; 51/284 R; 82/12; 82/18; 82/142; 82/147

[58] Field of Search ..... 82/1.11, 12, 18, 118, 82/123, 142, 147; 51/124, 165.71, 284 R

[56] References Cited

U.S. PATENT DOCUMENTS

| | | | |
|---|---|---|---|
| 3,900,971 | 8/1975 | Brueck | 51/100 |
| 3,902,227 | 9/1975 | Rupp | 51/33 |
| 3,913,274 | 10/1975 | Raford et al. | 51/58 |
| 4,051,751 | 10/1977 | Estrada | 82/12 |
| 4,132,036 | 1/1979 | Doi et al. | 51/124 |
| 4,178,720 | 12/1979 | Hashimoto | 51/124 |
| 4,203,062 | 5/1980 | Bathen | 82/137 |
| 4,232,485 | 11/1980 | Eadon-Allen | 51/55 |
| 4,264,249 | 4/1981 | Dawson | 409/199 |
| 4,274,313 | 6/1981 | Vulic | 82/12 |
| 4,419,846 | 12/1983 | Schmitzek et al. | 51/55 |
| 4,653,233 | 3/1987 | Brueck | 51/124 |
| 4,653,360 | 3/1987 | Compton | 82/18 |
| 4,679,471 | 7/1987 | Wauchope et al. | 82/12 |
| 4,680,998 | 7/1987 | Council, Jr. | 82/1 |
| 4,884,482 | 12/1989 | Council, Jr. | 82/1.11 |

*Primary Examiner*—William E. Terrell

*Attorney, Agent, or Firm*—Pettis & McDonald

[57] ABSTRACT

A lathe and a method of using the lathe are disclosed for forming an aspheric surface on a workpiece, in which the workpiece is mounted to a holder that is rotatably carried by the spindle, headstock and bed of a lathe, with that spindle and workpiece being rotated about the axis of the spindle with the workpiece being engaged by a forming tool which forming tool is moved through an arcuate path about an axis that is generally transverse to the spindle axis. The method and apparatus provide further for determining the time-varying angular position of the forming tool along the arcuate path, for determining the time-varying angular position of a point on the workpiece about the spindle axis and for reciprocating the workpiece holder and the workpiece held thereby relative to the lathe headstock and to the forming tool in synchronization with the movement of the forming tool and with the rotation of the workpiece about the spindle axis to form the desired contoured surface. Specified relationships are given for the movement of the workpiece holder along the spindle axis in relationship to the angle of rotation of the workpiece about its axis, the movement of the forming tool and the radii of curvature desired.

6 Claims, 3 Drawing Sheets

METHOD AND APPARATUS FOR CUTTING AN ASPHERIC SURFACE ON A WORKPIECE

STATEMENT OF RELATED APPLICATION

This application is a divisional application of U.S. patent application Ser. No. 276,230 filed Nov. 22, 1988, and entitled "Method and Apparatus for Cutting an Aspheric Surface on a Workpiece."

BACKGROUND OF THE INVENTION

This invention relates generally to the field of machining three dimensional surfaces on workpieces. More particularly it relates to the cutting of aspheric surfaces on workpieces. The invention finds particular utility in the field of optics in which it is desired to form any of a variety of aspheric surfaces, including toric surfaces, on a workpiece such as a lens blank.

In various fields of activity it is desirable to cut aspheric surfaces on workpieces. One such field of activity in which this is particularly desirable is that of optics, particularly the fields of optometry and ophthalmology, in which corrective lenses are prescribed for individual visual defects. Simple defects such as nearsightedness or farsightedness are corrected by the use of lenses having spherical surfaces. However, more complex defects, such as astigmatism, require a more unusual configuration of lens having at least one aspheric surface.

As described in my previous patent, U.S. Pat. No. 4,680,998, lenses for correcting astigmatism must have a cylindrical, rather than or in addition to spherical, correction. Such a lens providing cylindrical correction will necessarily have a first radius of curvature in one plane or meridian and a second radius of curvature in the second plane or meridian. These two meridians are frequently orthogonal but not necessarily aligned with horizontal and vertical planes intersecting the eye in question. The lens configuration desired is that of a section of the surface of a torus, thus yielding a "toric" lens. This lens provides the necessary cylindrical correction for astigmatism by incorporating two different radii of curvature, one along each of the two orthogonal meridians.

In forming lenses, it is sometimes necessary to provide other aspheric surfaces as well. These may include toric lenses having non-orthogonal axes for the differing radii of curvature, or a bifocal having a sector shape portion of differing correction, or a progressive bifocal with increasing non-spherical refractive power in the lens at greater distances from the center.

With the foregoing explanation as background, the problem becomes how to create the desired contours. In my previous patent, U.S. Pat. No. 4,680,998, I described one form of such an apparatus, in which a conventional lens cutting lathe is provided with an oscillating tool post. In this apparatus a lens blank is mounted to and rotated by the lathe spindle, and a cutting tool is moved in an arc around the end of the workpiece while the cutting tool is oscillated in a sinusoidal motion by a rotary actuator to move the cutting the cutting tool toward and away from the workpiece in synchronization with the rotation of the workpiece. While this apparatus is satisfactory for cutting a predetermined toric surface, the rotary actuator inherently limits the range of types of aspheric surfaces that can be cut.

SUMMARY OF THE INVENTION

In order to overcome the disadvantages of the prior art apparatus and methods noted above, it is an object of the present invention to provide a method and apparatus for cutting an aspheric surface on a workpiece in which the workpiece holder is reciprocated relative to the tool holder. More particularly, it is an object of the invention to provide such a method and apparatus in which the workpiece and its holder are reciprocated relative to the headstock of the lathe to provide for relatively low mass of the reciprocating components. To achieve this and other objects that will become apparent to those skilled in the art, the invention provides both a method and a lathe for cutting an aspheric surface on a workpiece which the lathe includes a lathe bed, a headstock mounted to the lathe bed, a spindle carried by the headstock and supporting a workpiece holder and a workpiece, apparatus for selectively moving the workpiece holder relative to the spindle along the spindle axis in response to an actuating signal, a tool support mounted to the lathe bed and having a pivot axis generally normal to the spindle axis and being adapted to move a cutting tool mounted in the tool holder and contact with the workpiece and along an arc of predetermined radius generally transverse to the spindle axis, apparatus for providing a signal indicative of the angular position of the tool holder along its arc, apparatus for providing a signal indicative of the angular position of the workpiece holder during rotation of the spindle and workpiece holder about the spindle axis, and signal integrating apparatus for integrating those signals indicating the tool holder angular position along the arc and the angular position of the workpiece holder about the spindle axis and for generating an actuating signal for controlling the axial movement of the workpiece holder relative to the spindle. By use of this apparatus and method, both the workpiece holder and any workpiece held thereby are moved axially in a predetermined relationship both with the rotation of the workpiece holder about the spindle axis and with movement of the tool holder along its arc of movement to cut a predetermined aspheric surface on the workpiece.

DESCRIPTION OF THE DRAWINGS

One particularly preferred embodiment of the apparatus of this invention and the manner of its use in practicing the method of this invention is illustrated in the attached figures in which.

DETAILED DESCRIPTION OF A PREFERRED EMBODIMENT

Figure 1:
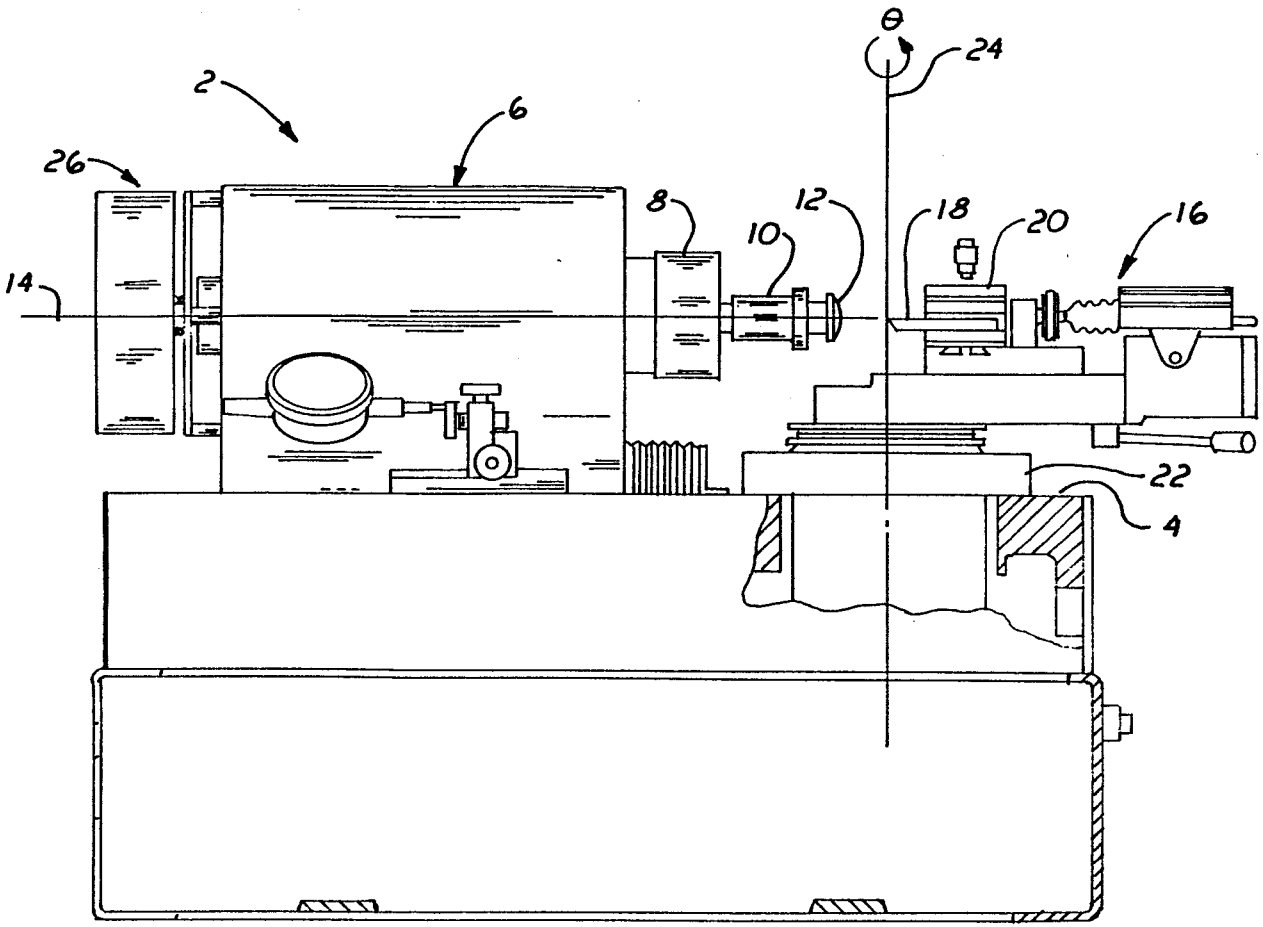
FIG. 1 is a side elevational view of a lathe according to this invention.

A particularly preferred embodiment of the lathe for practicing the present invention is illustrated in FIG. 1. Where the workpiece is to be formed by the invention comprise contact lenses having aspheric surfaces, one suitable and preferred embodiment of the lathe of this invention may be one of the computerized numerical controlled lathes manufactured by Citycrown, Inc., and suitably modified in the manner described below. This lathe, generally indicated by the reference numeral 2 includes generally a lathe bed 4, a headstock 6 mounted to the lathe bed, a spindle 8 carried by the headstock for supporting and rotating a workpiece holder 10, conventionally referred as a drawbar, and a workpiece, such as a lens blank 12 carried by the workpiece holder. The spindle 8, workpiece holder 10 and workpiece 12 are carried by the headstock for rotation about an axis 14 extending longitudinally through the spindle 8.

The lathe further includes tool holder assembly, which is generally indicated by reference numeral 16 and is substantially similar to the automatic quadrant tool holder manufactured by Citycrown, Inc. The tool holder assembly includes the conventional cutting tool 18 held by clamp 20 carried by a support that is mounted to a motor driven quadrant 22 for pivoting movement about an axis 24. This axis 24 is generally normal to the spindle axis 14, and the pivoting movement of the tool holder assembly about the axis 24 conventionally is in an arc of about 180°, extending about 90° either side of the spindle axis 14. Attached to the headstock 6 at the end opposite the workpiece 12 is an actuating mechanism generally indicated by reference numeral 26 for moving the workpiece holder and workpiece relative to the spindle 8 and along the spindle axis 14, in a manner to be described below.

Figure 2:
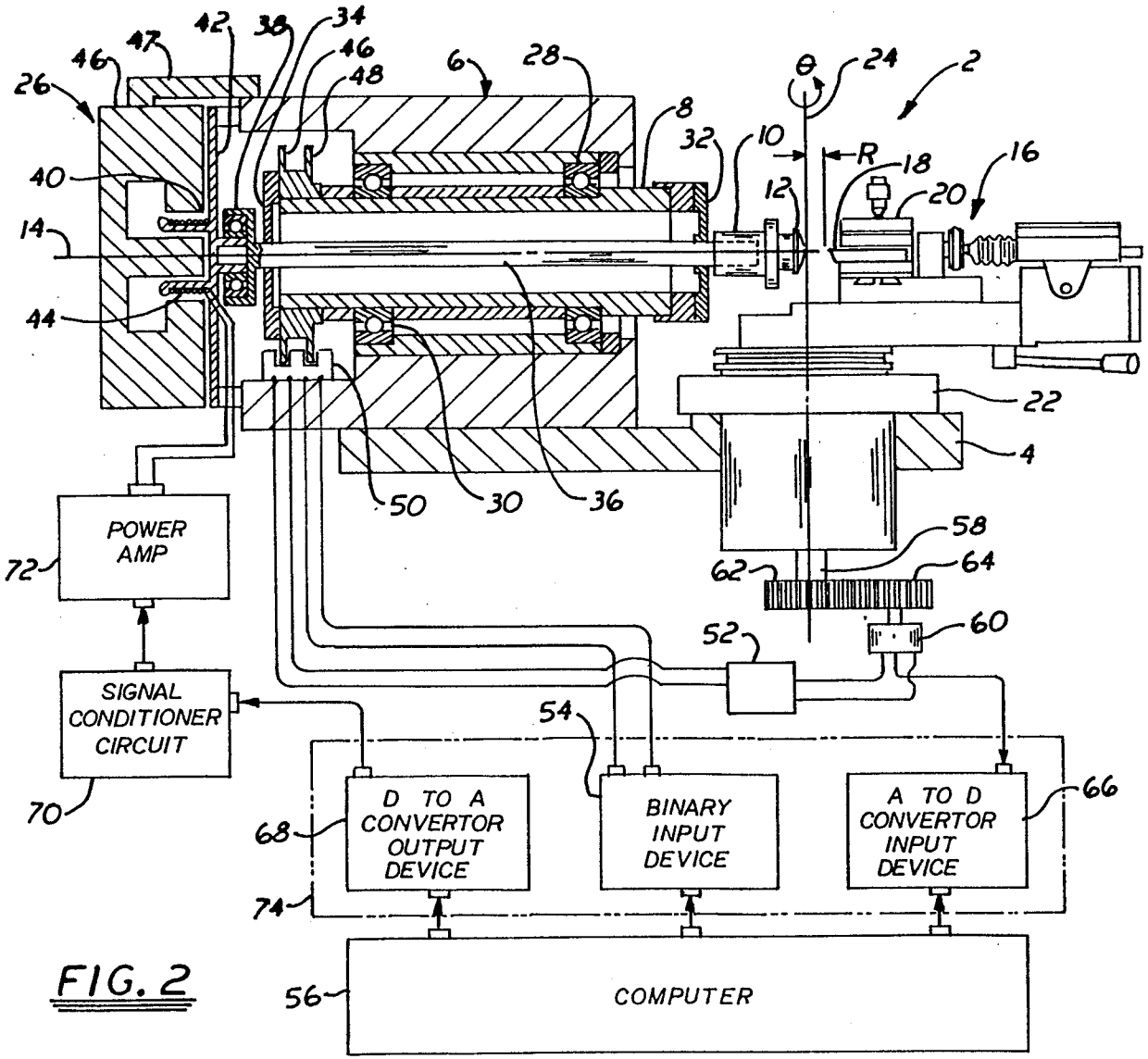
FIG. 2 is a schematic representation of the basic functional components of the lathe of this invention with certain portions shown in section and other portions removed for clarity of illustration.

In the schematic and partially sectional illustration of FIG. 2 are illustrated many of the functional elements of the apparatus of this invention that contribute to distinguishing this apparatus from that of a conventional lens cutting lathe. In addition to the conventional portions of the lathe described above with respect to FIG. 1, the illustration of FIG. 2 shows how the spindle 8 preferably is a hollow member supported within the headstock on bearings such as ball bearings 28 and 30. Preferably these bearings are preloaded to restrain the spindle against any radial or axial movement while permitting free rotation about the axis 14. Suitably mounted to each end of the spindle 8 for rotation therewith are resiliently deflectable means 32 and 34, such as metallic diaphragms, for mounting the drawbar 36 and its workpiece holder 10 to the spindle 8 for rotation therewith and for permitting some axial movement of the workpiece holder along the axis 14 while preventing any movement radial to that axis. These resiliently deflectable diaphragms 32 and 34 are formed such that, absent axial force exerted on such drawbar 36, the drawbar and workpiece holder will remain in a predetermined axial position while remaining capable of axial deflection. Of course, it is to be understood that spring or fluid pressure operated devices could be substituted as full equivalents for the resiliently deflectable diaphragms 32 and 34. At the end of the drawbar 36 opposite the workpiece holder 10 is provided a rotary coupling, which may conveniently comprise a preloaded ball bearing assembly, to provide for rotary motion between two elements while restraining any radial or axial motion. This rotary coupling may conveniently comprise a mounting 38 for receiving the outer race of a ball bearing 40, the inner race of which engages a portion of means 42, which suitably may be in the form of a leaf spring structure, that is mounted to the headstock 6. This structure 42, which could be a leaf spring or numerous other forms of linkages well known to those in the art, provides for axial deflection of the central portion thereof, proximal the axis 14, while maintaining support adjacent the outer edges to prevent any radial movement about that axis 14. Also connected to this supporting member 42 is an element, such as an electromagnetic coil 44. This coil 44 is received within the poles of magnetic means, such as an annular permanent magnet 46 that is mounted to the headstock 6 by suitable attachments or brackets 47. In connection with this magnet 46, the coil 44, which receives electrical signals described below, functions in a manner akin to the voice coil of an audio speaker, providing for controlled axial movement of that coil 44 and, through the rotary coupling, to the drawbar 36, workpiece holder 10 and workpiece 12, all for purposes to be described below.

Connected to the lathe spindle 8 for rotation with both that spindle and with the workpiece holder 10 and workpiece 12 are means for providing a signal indicative of the angular position of the axis and thus of the workpiece holder during rotation of the spindle and workpiece holder 10 about the spindle axis 14. One convenient form the signal providing means suitably comprises a digital shaft encoder assembly, including a pair of conventional chopper rings 46 and 48, a portion of each of which are received within the assembly 50, conveniently comprising a pair of light emitting diodes providing for projecting light through the gaps in the chopper rings 46 and 48 for reception by conventional optical sensors. The light emitting diodes of this assembly 50 are powered by a conventional power supply 52. Preferably one of the chopper rings, such as ring 46, has a single radial slot positioned within it for permitting passage of light, while the other chopper ring, such as ring 48, possesses a plurality, such as 36, equally spaced such slots. The optical sensors within the assembly 50 provide output signals indicative of the angular position of rotation of the spindle to a binary input device 54 and then into a computer 56 for purposes to be described below.

As described above, the tool holder assembly 16 includes a tool mount 20 for holding a cutting tool 18 mounted on a conventional motor drive quadrant 22 for swinging the assembly in an arc about axis 24. Connected to this quadrant drive are means for providing a signal indicative of the angular position $\theta$ of the tool holder along the arc about axis 24. The signal providing means may include an output shaft 58 that rotates with the tool support 20 about the axis 24 and a signal generating device, such as a potentiometer 60 or an absolute position rotary shaft encoder. The potentiometer 60 is operatively connected to output shaft 58 by any convenient means, such as a gear assembly including driving gear 62 attached to shaft 58 and pinion 64 attached to the shaft of potentiometer 60 for driving that potentiometer. The potentiometer 60, which is conventional in the art, receives electrical power for an appropriate source, such as power supply 52, and provides an output signal indicative of the rotation and thus angular position $\theta$ of shaft 58 to the analog-to-digital converter input device 66. The signal thus provided to the input device 66 is therefore indicative of the angular position $\theta$ about the axis of rotation 24. This analog-to-digital converter input device 66 provides a signal indicative of the angular position of the tool mount assembly 16 to the computer 56, and the binary input device 54 provides its signal indicative of the angular position of rotation of the spindle and workpiece about the spindle axis 14 also to the computer. While the computer may be any of a variety of digital computers, in this preferred embodiment it comprises a Compaq Deskpro Model 386/20 digital computer programmed in compiled Basic. This computer 56 provides an output signal to a digital-to-analog converter output device 68, which subsequently provides a signal to a signal conditioner circuit 70 and thus to a power amplifier 72 and ultimately to the coil 44 for actuation of the coil 44 and thus movement of the workpiece holder and workpiece along the axis 14, in a manner to be described below. The analog-to-digital converter input device 66, binary input device 54 and digital-to-analog converter output device 68 conveniently may comprise an IBM Data Acquisition and Control Adapter 74. This adapter is commercially available from IBM and comprises a 16-bit binary input device, a 12-bit analog-to-digital converter device and a 12-bit digital-to-analog output device.

Figure 3:
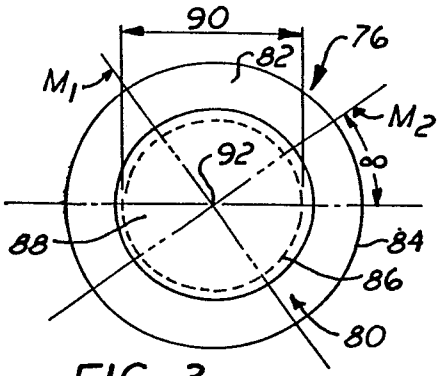
FIG. 3 is an enlarged front view of an aspheric lens formed by the method and apparatus of the present invention.
Figure 4:
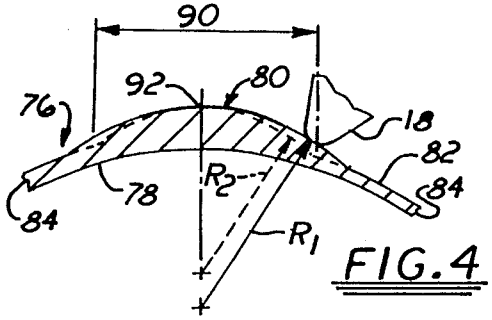
FIG. 4 is a side sectional view of the lens of FIG. 1 illustrating the two radii of curvature of a toric lens with the larger radius shown in the solid representation and the smaller radius, which is oriented orthogonal to the larger radius, shown by the broken line representation.

While the apparatus and method of the present invention may be utilized to cut any of a wide range of aspheric surfaces on numerous types of workpieces, for purposes of illustration it will be described in connection with the cutting of a convex toric surface on a contact lens. Such description is in no way to be considered limitative of the application or types of surfaces that may be cut. Such a lens 76, as illustrated in FIGS. 3 and 4, has a spherical concave surface 78 for contacting the cornea. That spherical surface may be formed in any of the conventional manners, such as by use of a Citycrown, Inc. automatic base curve lathe. The convex face 80 of the lens 76 has a basic spherical surface 82 that extends about the periphery of the lens from the edge 84 to an annular blend zone 86. The toric surface 88 is positioned in the optical zone of the lens whose extent is indicated generally by the extension line and the arrow 90. The toric surface 88 generally comprises an area of less than one-half the total area of the convex surface of the lens and preferably less than one-fourth that total area. Where the blend zone 86 meets the basic spherical front surface 82 of the lens the juncture is indicated by the solid inner circle on FIG. 3. However, the joining of the blend zone 86 with the toric portion 90 is gradual and is indicated by the broken circular line on FIG. 3.

As best shown in FIG. 4, the toric surface 88 has a first radius of curvature $R_1$, which is also referred to as flat radius. Orthogonally to that flat radius $R_1$ is a second radius of curvature $R_2$, which is also known as the steep radius. The radius $R_1$ is the radius of curvature along the meridian $M_1$ of FIG. 3, and the radius $R_2$ is the radius of curvature along the meridian $M_2$ orthogonal to $M_1$ in FIG. 3. These differing radii of curvature impart the desired toricity to this lens. The curves defined by the two radii of curvature $R_1$ and $R_2$ meet at the center or common apex 92 of the lens.

In FIG. 4 is also indicated the tip of cutting tool 18 engaging the convex outer surface of the lens 76 in the manner generally as would occur during the cutting of such a lens.

With the foregoing explanation of both the lathe and one exemplary type of lens that may be cut thereby, the manner and method of operation of this invention may now be explained. The operation is carried out by mounting a workpiece 12, such as a lens blank, in the workpiece holder or chuck 10 attached to the drawbar 36 of the lathe 2 of this invention. The computer is then provided by the operator with the necessary information and programming to achieve the desired cut. This information includes the following:

(a) average radius of curvature of the optical zone 90 of the lens, in millimeters, this average being between the flat radius $R_1$ and the steep radius $R_2$;

(b) the radius difference, s, equal to the difference between the flat radius $R_1$ and the steep $R_2$, in millimeters;

(c) the axis angle $\alpha$ (FIG. 3) between the meridians of the toricity and the standard orientation of the lens, from 0° to 170°, suitably in 10° increments;

(d) the diameter in millimeters of the optical zone 90; and (e) the diameter in millimeters of the blend zone 86.

Figure 5:
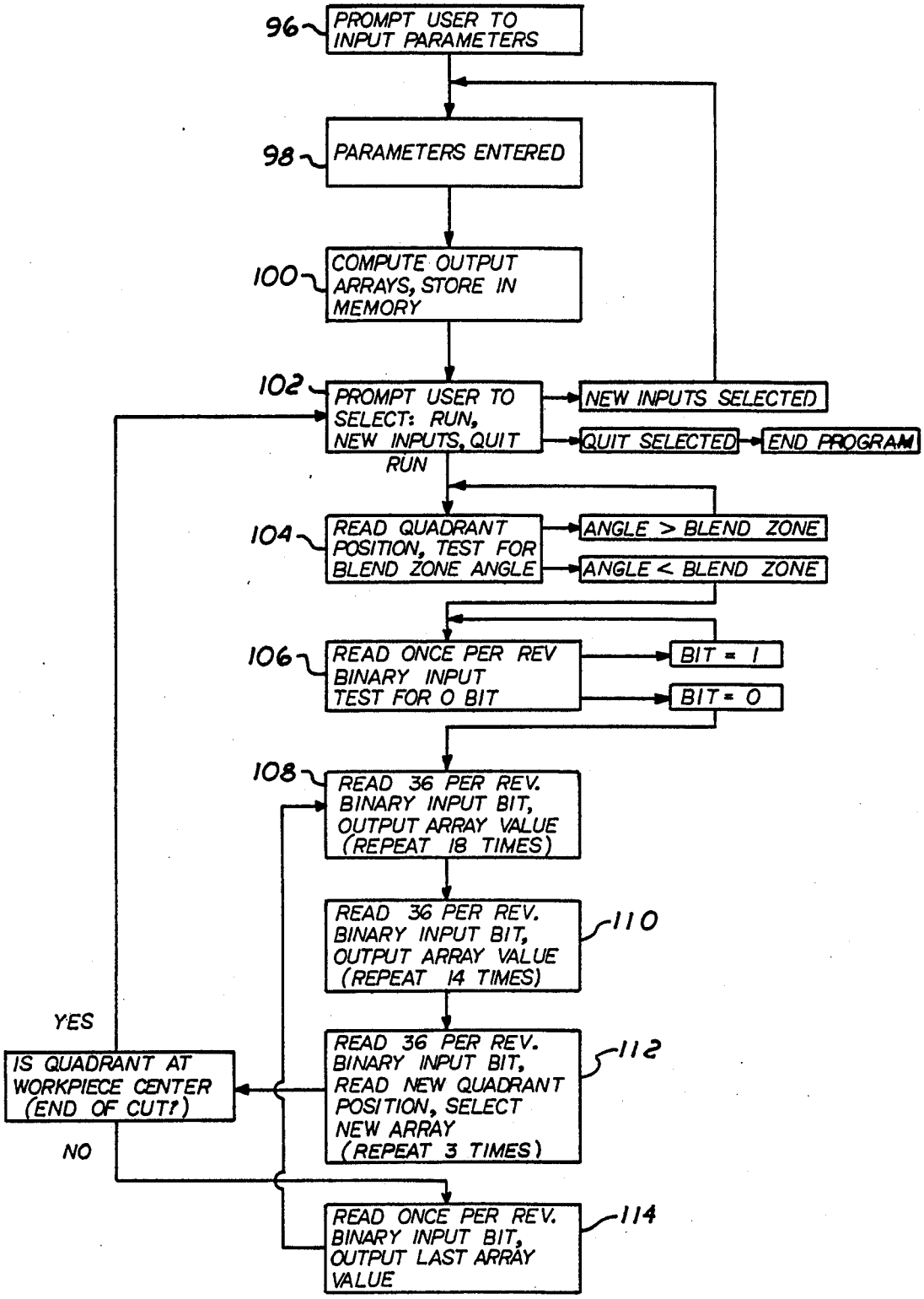
FIG. 5 is a schematic flow chart depicting the sequence of process steps in accordance with the method of the present invention.

When all of these parameters have been entered into the computer, as by the keyboard, for application in a computer program, such as that illustrated in the flow chart of FIG. 5, the cutting of the lens may proceed. Because the coding of the program of FIG. 5 can be implemented in numerous ways, depending upon the programming language and other minor variables by a programmer of average skill, the program is set forth in the form of this flow chart.

After the prompting 96 for entering the parameters has resulted in the entry 98 of those parameters, the program enters a subroutine 100 to compute the output arrays and store them in memory. Specifically, the subroutine creates a waveform array with 18 numerical values varying from 0 to 4,096 that are expressed by:

$$\text{waveform array value} = 4{,}096 \times \sin^2\phi$$

where $\phi$ equals the angular position of the spindle along its axis of rotation in 10° increments from 0° to 360°. The subroutine also creates an axis shifted waveform array that uses the axis angle $\alpha$ input by the user as expressed by:

$$\text{shifted waveform array value} = 4{,}096 \times \sin^2(\phi + \alpha)$$

where $\phi$ equals 0° to 360° in 10° increments as above and $\alpha$ equals the axis shift in 10° increments. Next, the subroutine computes the blend zone angle and optical zone angle. The blend zone angle is expressed as the angle of the lathe quadrant measured from the spindle center line. Both angles are computed in radians and converted to values that correspond to the digital values received from the A to D converter 66 that enters the analog values from the quadrant angle transducer or potentiometer 60. These angles are expressed as:

$$\text{optical zone angles} = \arcsin\left(\frac{\text{optical zone diameter}}{\text{average radius} \times 2}\right)$$

$$\text{blend zone angle} = \arcsin\left(\frac{\text{blend zone diameter}}{\text{average radius} \times 2}\right)$$

This provides the digital equivalent of the optical zone angle and the blend zone angle.

Next, the subroutine computes a multipler M for each quadrant position number from the optical zone angle to 0 (the center line) according to the following equation:

$$M=K\times A$$

where K equals the scaling factor and $$A=\sqrt{r^2\cos^2\theta+s^2+2rs}-\sqrt{r^2\cos^2\theta+s^2+2rs\cos\theta}$$

where r equals the average radius, between $R_1$ and $R_2$, s equals the difference between $R_1$ and $R_2$ and $\theta$ equals the quadrant angle.

Next, the subroutine computes a multiplier N for each quadrant position number from the optical zone to the blend zone angle according to the following relationship:

$$N=M_{o.z.}-(\text{current angle}-\text{optical zone angle})\times\frac{M_{o.z.}}{\text{blend zone angle}}$$

where $M_{o.z.}$ equals the value of multiplier M at the optical zone angle.

Next the subroutine computes a unique, 18 element array for every quadrant angle value from the largest angle, which is in the blend zone, to 0. The array values are computed in the following manner:

From the blend zone start angle to the optical zone start angle, $$\text{Array Values}=(\text{axis shifted waveform array})\times N$$

From the optical zone angle to 0 (the center line), $$\text{Array Values}=(\text{axis shifted waveform array})\times M$$

Finally, the subroutine converts each 18 element array to high and low byte values and stores them in memory. The location of each array is mapped according to the relationship that:

$$\text{Memory Offset}=28672+(3\times N),$$

where $$N=\text{Quadrant Angle}=\frac{\theta}{.000462}$$

The number 28672 is an arbitrary memory boundary of the computer used in this embodiment. The number 0.000462 is an arbitrary angle (radians) to digital equivalent angle conversion factor. This step completes the computation and storing of block 100 in the flow chart of FIG. 5.

When the output arrays have been stored, the program then prompts the user, as in flow chart box 102, to select either of three options, to run the program, to enter new lens parameters or to quit the program. Then the user chooses to cut an aspheric surface on the workpiece by running the program, the lathe operator first sets the average radius r for the radius of curvature, as shown on FIG. 2. In FIG. 2 the size of the radius is greatly exaggerated for purposes of illustration. With that average radius then set, the user starts the lathe into its automatic cutting sequence. At that point the computer begins a high speed loop 104 that reads the quadrant position and performs an A to D conversion on the input signal from the quadrant transducer 60. The computer makes a comparison with the blend zone angle previously computed to determine if the current angle is greater than or less than the blend zone angle desired. If it is greater, then the quadrant position is reread. If the current angle is less than the blend zone angle, the program proceeds to box 106.

When the angle of the quadrant appears to be satisfactory, the computer begins a high speed loop 106 that reads in the status of the once per revolution shaft encoder bit from the optical sensor of assembly 50 as generated by the chopper ring 46. The bit is normally a "1". When the bit changes to "0", the beginning of a revolution is detected and the program proceeds to functional block 108. At this point the computer begins another high speed loop that selects an array from memory corresponding to the current quadrant position. The low byte and high byte values of the array are read and stored as temporary variables. The computer then begins to read in the status of the 36 per revolution shaft encoder bit generated by the chopper ring 48 and sensor of the assembly 50. When the bit changes from "1" to "0", this signifies that the shaft has rotated 10°. The program then reads out the low and high bytes into the appropriate output registers for the digital to analog conversion to be made by the D to A converter 68. The next sequential array values of low and high bytes are read from memory, and the process is repeated 18 times, until 180° of shaft rotation have been completed. When that rotation has been completed the cycle of functional block 108 is repeated for 14 more cycles (box 110). During the final four of those output cycles, the quadrant position signal is entered and the next array selection is made. At this same time, a test is performed to detect if the center line quadrant position has been reached, which would signal the end of a cut. If it has been reached, the program disengages from the high speed output subroutines and prompts the user for additional direction in functional block 102. If the center line quadrant position has not been reached, the once per revolution binary output bit generated by chopper ring 46 is read and the last array value is output to functional block 108 for repeat processing.

As a result of this program the computer provides the necessary actuating signal through D to A converter output device 68 to a signal conditioner circuit 70. This signal conditioner circuit steps down the D to A converter output voltage in a conventional manner by a dropping resistor and smoothes the voltage in the conventional manner by capacitor. This conditioned signal thus is a direct computer synthesized waveform, synchronized with the rotation of the lathe spindle at two complete cycles per revolution. The amplitude of the signal is also modulated by a mathematical transfer function generated by the computer from the quadrant position indicating signal from the transducer 60, with that transfer function tapering the signal to zero amplitude at the center of the lens. The signal amplitude tapers linearly from zero to maximum as the quadrant moves from the beginning of the blend zone to the edge of the optical zone and tapers according to the desired curvature from the beginning of the optical zone to the lens centerline. This conditioned signal is then applied to a power amplifier 72, which may conveniently be an audio amplifier that is set to a fixed gain, typically on the order of 10 to 35. The amplified signal from power amp 72 is then fed to the actuating coil 44 that is positioned within the pole pieces of the annular magnet 46, which magnet provides a radial magnetic field. The signal from amplifier 72 applied to the coil 44 thus creates an electromotive force in an axial direction along the spindle axis 14, which force is a linear function of the current of that amplified signal, in a manner analogous to that of the voice coil of an audio speaker.

Because the coil 44 is suspended on resilient members 42, such as leaf springs, these members 42 prevent any rotational movement of the coil 44 but permit such axial movement. The engagement of the shoulder of the member 42 with the inner race of the rotary coupling, which conveniently comprises the ball bearing assembly 40, transmits the axial movement of the coil 44 to the drawbar 36 that is supported within the spindle 8 by the resiliently deflectable members 32 and 34. These members 32 and 34 preferably are preloaded against one another to eliminate any lost motion and to urge the drawbar to a predetermined axial position in the absence of axial force from the coil 44. As shown in FIG. 2, the workpiece holder or arbor 10 holds the workpiece, such as a contact lens blank, for rotation and axial movement with the drawbar 36. Thus, any movement by the coil 44 is transmitted through the rotary coupling to the drawbar 36 and ultimately to the workpiece 12.

As the spindle 8 rotates, the cutting tool 18 mounted on the quadrant 22 swings through a circular arc about the axis of rotation 24. During this time the lens is rotated by the spindle 8 and is reciprocated in an axial direction a distance equal to the difference in the sagittal depth between the flat curve of radius $R_1$ and the steep curve of radius $R_2$ of the desired toric surface. This axial movement tapers to zero as the quadrant swings the cutting tool to the center line, which is the axis 14. By reciprocating the workpiece 12 while the cutting tool 18 is pivoted about the axis 24, and with this reciprocation being synchronized with the rotation of the workpiece 12 about the axis 14, the desired aspheric surface, in this case a toric surface, is cut by the cutting tool.

When the signal from transducer 60 indicates that the quadrant has reached the center line (the axis 14), the computer program disengages from the high speed output subroutine and returns to functional block 102, prompting the user for direction. The user may respond either by entering new parameters to cut another surface or, if finished with the work, may quit and end the program.

By the use of the apparatus and method of this invention any of a wide variety of aspheric surfaces may be produced. The detailed description above sets forth the manner of producing a conventional toric surface having orthogonal, flat and steep radii. Alternatively, by the use of a different amplitude modulated waveform an enhanced toric surface having a convex or concave optical zone may be produced. Such a waveform may be defined by $$y=K(\sin^N\phi)A$$

where K equals a scale factor, $\phi$ equals the angle of rotation of a predetermined point on a workpiece about the spindle axis and $$A=\sqrt{r^2\cos^2\theta+s^2+2rs}-\sqrt{r^2\cos^2\theta+s^2+2rs\cos\theta}$$

where $\theta$ equals the quadrant angle, r equals the average radius and s equals the radius difference.

By the use of this relationship the general form is identical to the conventional toric surface except that the power which is a non-negative number N may be altered to enhance the toric characteristics. Specifically, for:

$N=2$, pure toricity is produced
$N=3$, the flat curve is narrowed
$N\geqq 4$, the flat curve is very narrow or "banded"
$N=1$, the flat curve is broadened
$N<1$, the steep curve is narrowed or "banded"

As an additional type of surface, other convex or concave optical zones on a toric surface may be produced by using the amplitude modulated waveform $$y=K(\sin^2\phi)B$$

where $$B=1-K_{M1}\cos^{N1}\theta-K_{M2}\cos^{N2}\theta\ldots K_{Mm}\cos^{Nn}\theta,$$

where $K_{M1}$, and $K_{M2}\ldots K_{Mm}$ are selected constants, $N_1$, $N_2\ldots N_n$ are non-negative numbers.

This relationship changes the amplitude modulation function to produce increased or decreased power in the central or peripheral zones of the optical zone.

Non-orthogonal toric surfaces may also be produced with convex or concave optical zones by use of the amplitude modulated waveform $$y=K\times\sin^2(M\phi)\times A$$

for $$\phi=0^\circ \text{ to } (90/M)^\circ \text{ and for } \phi=180^\circ \text{ to } 180+(90/M)^\circ$$

for $$\phi=(90/M)^\circ \text{ to } 180^\circ \text{ and from } 180^\circ+(90/M)^\circ \text{ out to } 360^\circ,$$

the relationship is $$y=K\times\sin^2\left(\frac{\phi}{N}+P\right)\times A$$

where M, N and P are constants. By proper selection of these constants this method and apparatus can produce a non-orthogonal toric surface in which the flat and steep radii are not perpendicular to one another.

Another application of interest in the optometric field is the production of a sector bifocal having a convex optical zone. This lens is identical to the conventional toric described above, except that the axis of the cylindrical radius is fixed at 90° with a flat radius in the vertical plane and the waveform is blanked or set to zero for half of the spindle rotation. The half revolution "toric" becomes a bifocal add zone for minus power lenses, or the axis can be fixed at zero and a bifocal add zone can be produced for a plus power lens. The bifocal thus produced will have no jump, so that the optical center of the reading and distance points will meet at the center of the optical zone. The size of this sector bifocal add zone can be reduced by confining the "pseudo-toricity" to less than half a revolution, such as 90° rather than a full 180°.

An additional type of lens that may be produced by this method and apparatus is the progressive bifocal having a convex optical zone. This lens is produced in a manner similar to the sector bifocal described above, except that an aspheric amplitude modulation similar to that described with respect to the aspheric toric is utilized. The net effect is to provide an add zone with increasing nonspherical refractive power in the add periphery zone.

Yet another and even more complex lens that may be produced by this invention is that of the field mapped multi-focal lens having convex or concave optical zones. Such a lens has no mathematically describable optical surface in the lens optical zone. Instead, the visual field of the lens is mapped by using a central peripheral vision method that gives an accumulated plot of the required lens powers, with varying power being applied to differing sectors and differing radial portion of the lens. To achieve this structure the amplitude modulated waveform arrays would be calculated by using a ray tracing technique to produce a multiplicity of local lens powers and thus radii of curvature to match the desired power map of the lens.

In addition to the various optical applications noted above, the apparatus and method of this invention can be used in numerous other areas with equal facility. For example, the apparatus and method would be useful for the grinding of complex topographies in metals and rigid plastics to produce desired nonspherical surfaces. Such capability would have application on molds to be used to make precision shapes such as optical lenses. The single point cutting tool of a conventional radius turning lathe might be replaced with a high speed grinding tool to provide for grinding of such materials.

While the foregoing sets forth in detail a particularly preferred embodiment of the method and apparatus of this invention, along with a number of applications thereof, it is to be understood that these examples are to be considered illustrative solely of the principles of the invention and are not to be considered limitative thereof. Accordingly because numerous variations and modifications of this method and apparatus, all within the scope of the invention, will readily occur to those skilled in the art, the scope of the invention is to be limited solely by the claims appended hereto.

What is claimed is:

1. A lathe for cutting an aspheric surface on a workpiece, said lathe comprising a lathe bed;

a headstock mounted to said lathe bed;

a spindle carried by said headstock for supporting and rotating a workpiece holder and a workpiece carried thereby about an axis extending longitudinally through said spindle, with a surface of said workpiece facing axially outwardly of said spindle and said workpiece holder, said workpiece holder being mounted to said spindle for movement relative to said spindle along said spindle axis;

a tool support mounted to said lathe bed and having a pivot axis generally normal to said spindle axis, said tool holder being adapted to move a forming tool mounted in said tool holder in contact with said workpiece and along an arc of predetermined radius about an axis that is generally transverse to said spindle axis and intermediate said workpiece surface and said headstock;

means for selectively moving said workpiece holder relative to said spindle along said spindle axis in response to an actuating signal such that the distance between said forming tool movement axis and said workpiece surface varies selectively between a first distance $R_1$ and a second distance $R_2$;

means for providing a signal indicative of the angular position of said workpiece holder during rotation of said spindle and workpiece holder about said spindle axis;

signal integrating means for integrating said signals indicating said forming tool holder angular position along said arc and said angular position of said workpiece holder about said spindle axis and for generating an actuating signal for controlling said axial movement of said workpiece holder relative to said spindle, said actuating signal having a waveform defining said axial movement of said workpiece holder in the y direction along said spindle axis as $$y = K(\sin^N \phi)A,$$

where K is a scale factor, N is a non-negative number, $\phi$ is the angle of rotation of a predetermined point on said workpiece about said spindle axis and $$A = \sqrt{r^2\cos^2\theta + s^2 + 2rs} - \sqrt{r^2\cos^2\theta + s^2 + 2rs\cos\theta}$$

where $\theta$ is the angular position of said cutting tool along said arc of movement, r is the average of $R_1$ and $R_2$, and s equals the difference between $R_1$ and $R_2$, whereby the workpiece holder and any workpiece held thereby are moved axially in a predetermined relationship both with the rotation of the workpiece holder about the spindle axis and with movement of the tool holder along its arc of movement to cut a predetermined aspheric surface on the workpiece.

2. A lathe for cutting an aspheric surface on a workpiece, said lathe comprising a lathe bed;

a headstock mounted to said lathe bed;

a spindle carried by said headstock for supporting and rotating a workpiece holder and a workpiece carried thereby about an axis extending longitudinally through said spindle, with a surface of said workpiece facing axially outwardly of said spindle and said workpiece holder, said workpiece holder being mounted to said spindle for movement relative to said spindle along said spindle axis;

a tool support mounted to said lathe bed and having a pivot axis generally normal to said spindle axis, said tool holder being adapted to move a forming tool mounted in said tool holder in contact with said workpiece and along an arc of predetermined radius about an axis that is generally transverse to said spindle axis and intermediate said workpiece surface and said headstock;

means for selectively moving said workpiece holder relative to said spindle along said spindle axis in response to an actuating signal such that the distance between said forming tool movement axis and said workpiece surface varies selectively in response to said actuating signal;

means for providing a signal indicative of the angular position of said workpiece holder during rotation of said spindle and workpiece holder about said spindle axis;

signal integrating means for integrating said signals indicating said forming tool holder angular position along said arc and said angular position of said workpiece holder about said spindle axis and for generating an actuating signal for controlling said axial movement of said workpiece holder relative to said spindle, said actuating signal having a waveform defining said axial movement of said workpiece holder in the y direction along said spindle axis as $$y=K(\sin^2\phi)B,$$

where K is a scale factor, $\phi$ is the angle of rotation of a predetermined point on said workpiece about said spindle axis and $$B=1-K_{M1}\cos^{N1}\theta-K_{M2}\cos^{N2}\theta \ldots K_{Mm}\cos^{Nn}\theta,$$

where $K_{M1}$, $K_{M2} \ldots K_{Mm}$ *are selected constants*, $N_1$, $N_2 \ldots N_n$ are non-negative numbers, and $\theta$ equals the angle of movement of said cutting tool along said arc, whereby the workpiece holder and any workpiece held thereby are moved axially in a predetermined relationship both with the rotation of the workpiece holder about the spindle axis and with movement of the tool holder along its arc of movement to cut a predetermined aspheric surface on the workpiece.

3. A lathe for cutting an aspheric surface on a workpiece, said lathe comprising a lathe bed;

a headstock mounted to said lathe bed;

a spindle carried by said headstock for supporting and rotating a workpiece holder and a workpiece carried thereby about an axis extending longitudinally through said spindle, with a surface of said workpiece facing axially outwardly of said spindle and said workpiece holder, said workpiece holder being mounted to said spindle for movement relative to said spindle along said spindle axis;

a tool support mounted to said lathe bed and having a pivot axis generally normal to said spindle axis, said tool holder being adapted to move a forming tool mounted in said tool holder in contact with said workpiece and along an arc of predetermined radius about an axis that is generally transverse to said spindle axis and intermediate said workpiece surface and said headstock;

means for selectively moving said workpiece holder relative to said spindle along said spindle axis in response to an actuating signal such that the distance between said forming tool movement axis and said workpiece surface varies selectively between a first distance $R_1$ and a second distance $R_2$;

means for providing a signal indicative of the angular position of said tool holder along said arc;

means for providing a signal indicative of the angular position of said workpiece holder during rotation of said spindle and workpiece holder about said spindle axis;

signal integrating means for integrating said signals indicating said forming tool holder angular position along said arc and said angular position of said workpiece holder about said spindle axis and for generating an actuating signal for controlling said axial movement of said workpiece holder relative to said spindle, said actuating signal having a waveform defining said axial movement of said workpiece holder in the y direction along said spindle axis as $$y=K(\sin^2(M\phi))A,$$

for $$\phi=0^\circ \text{ to } (90/M)^\circ \text{ and for } \phi=180^\circ \text{ to } (180+(90/M))^\circ,$$

and $$y=K(\sin^2(\phi/N+P))A$$

for $$\phi=(90/M)^\circ \text{ to } 180^\circ \text{ and for } \phi=(180+(90/M))^\circ \text{ up to } 360^\circ,$$

where K is a scale factor, M, N and P are constants and $$A=\sqrt{r^2\cos^2\theta+s^2+2rs}-\sqrt{r^2\cos^2\theta+s^2+2rs\cos\theta}$$

where $\theta$ is the angular position of said cutting tool along said arc of movement, r is the average of $R_1$ and $R_2$, and s equals the difference between $R_1$ and $R_2$, whereby the workpiece holder and any workpiece held thereby are moved axially in a predetermined relationship both with the rotation of the workpiece holder about the spindle axis and with movement of the tool holder along its arc of movement to cut a predetermined aspheric surface on the workpiece.

4. A method of forming an aspheric surface on a workpiece, comprising the steps of mounting a workpiece to a workpiece holder that is rotatably carried by the spindle, headstock and bed of a lathe;

rotating said spindle, said workpiece holder and said workpiece about the axis of rotation of said spindle, which is defined as the y axis;

engaging a surface of said workpiece with a forming tool and moving said forming tool through an arcuate path about an axis that is fixed relative to said lathe bed during said engagement and is generally transverse to said spindle axis and positioned intermediate said workpiece surface and said headstock;

determining the time-varying angular position of a point on said workpiece about said spindle axis;

reciprocating said workpiece holder and said workpiece held thereby along said spindle axis y and relative to both said lathe headstock and said forming tool in synchronization with both said movement of said forming tool and said rotation of said workpiece about said spindle axis, such that said synchronized reciprocation of said workpiece during said forming tool engagement and movement effects forming of a contoured surface having at least two different radii of curvature $R_1$ and $R_2$ on said workpiece, said reciprocation along said y axis having a relationship with said workpiece rotation and said forming tool movement defined by $$y=K(\sin^N\phi)A,$$

where K is a scale factor, N is a non-negative number, $\phi$ is the angle of rotation of a predetermined point on said workpiece about said spindle axis and $$A = \sqrt{r^2\cos^2\theta + s^2 + 2rs} - \sqrt{r^2\cos^2\theta + s^2 + 2rs\cos\theta}$$

where $\theta$ is the angular position of said cutting tool along said arc of movement, r is the average of $R_1$ and $R_2$, and s equals the difference between $R_1$ and $R_2$.

5. A method of forming an aspheric surface on a workpiece, comprising the steps of mounting a workpiece to a workpiece holder that is rotatably carried by the spindle, headstock and bed of a lathe;

rotating said spindle, said workpiece holder and said workpiece about the axis of rotation of said spindle, which is defined as the y axis;

engaging a surface of said workpiece with a forming tool and moving said forming tool through an arcuate path about an axis that is fixed relative to said lathe bed during said engagement and is generally transverse to said spindle axis and positioned intermediate said workpiece surface and said headstock;

determining the time-varying angular position of said forming tool along said arcuate path;

determining the time-varying angular position of a point on said workpiece about said spindle axis;

reciprocating said workpiece holder and said workpiece held thereby along said spindle axis y and relative to both said lathe headstock and said forming tool in synchronization with both said movement of said forming tool and said rotation of said workpiece about said spindle axis, such that said synchronized reciprocation of said workpiece during said forming tool engagement and movement effects forming of a contoured surface, said reciprocation along said y axis having a relationship with said workpiece rotation and said forming tool movement defined by $$y = K(\sin^2\phi)B,$$

where K is a scale factor, $\phi$ is the angle of rotation of a predetermined point on said workpiece about said spindle axis and $$B = 1 - K_{M1}\cos^{N1}\theta - K_{M2}\cos^{N2}\theta \ldots K_{Mm}\cos^{Nn}\theta,$$

where $K_{M1}$, $K_{M2}$ . . . $K_{Mm}$ are selected constants, $N_1$, $N_2$ . . . $N_n$ are non-negative numbers, and $\theta$ equals the angle of movement of said cutting tool along said arc.

6. A method of forming an aspheric surface on a workpiece, comprising the steps of mounting a workpiece to a workpiece holder that is rotatably carried by the spindle, headstock and bed of a lathe;

rotating said spindle, said workpiece holder and said workpiece about the axis of rotation of said spindle, which is defined as the y axis;

engaging a surface of said workpiece with a forming tool and moving said forming tool through an arcuate path about an axis that is fixed relative to said lathe bed during said engagement and is generally transverse to said spindle axis and positioned intermediate said workpiece surface and said headstock;

determining the time-varying angular position of said forming tool along said arcuate path;

determining the time-varying angular position of a point on said workpiece about said spindle axis;

reciprocating said workpiece holder and said workpiece held thereby along said spindle axis y and relative to both said lathe headstock and said forming tool in synchronization with both said movement of said forming tool and said rotation of said workpiece about said spindle axis, such that said synchronized reciprocation of said workpiece during said forming tool engagement and movement effects forming of a contoured surface having at least two different radii of curvature $R_1$ and $R_2$ on said workpiece, said reciprocation along said y axis having a relationship with said workpiece rotation and said forming tool movement defined by $$y = K(\sin^2(M\phi))A,$$

for $\phi = 0°$ to $(90/M)°$ and for $\phi = 180°$ to $(180 + (90/M))°$ and $$y = K(\sin^2(\phi/N + P))A$$

for $\phi = (90/M)°$ to $180°$ and for $\phi = (180 + (90/M))°$ up to $360°$, where K is a scale factor, M, N and P are constants and $$A = \sqrt{r^2\cos^2\theta + s^2 + 2rs} - \sqrt{r^2\cos^2\theta + s^2 + 2rs\cos\theta}$$

where $\theta$ is the angular position of said cutting tool along said arc of movement, r is the average of $R_1$ and $R_2$, and s equals the difference between $R_1$ and $R_2$.

* * * * *

UNITED STATES PATENT AND TRADEMARK OFFICE

CERTIFICATE OF CORRECTION

PATENT NO. : 4,947,715

DATED : Aug. 14, 1990

INVENTOR(S) : Buford W. Council, Jr.

It is certified that error appears in the above-identified patent and that said Letters Patent is hereby corrected as shown below:

Claim 1 at column 12 between lines 4 and 5, insert the following paragraph:

--means for providing a signal indicative of the angular position of said tool holder along said arc;--

Claim 2 at column 12 between lines 66 and 67, insert the following paragraph:

--means for providing a signal indicative of the angular position of said tool holder along said arc;--

Claim 2 at column 13, line 22, replace the italicized phrase "are selected constants $N_1$," with the non-italicized phrase --are selected constants, $N_1$,--

UNITED STATES PATENT AND TRADEMARK OFFICE

CERTIFICATE OF CORRECTION

PATENT NO. : 4,947,715

DATED : Aug. 14, 1990

INVENTOR(S) : Buford W. Council, Jr.

It is certified that error appears in the above-identified patent and that said Letters Patent is hereby corrected as shown below:

Claim 4 at column 14 between lines 50 and 51, insert the following paragraph:

--determining the time-varying angular position of said forming tool along said arcuate path;--.

Signed and Sealed this

Seventeenth Day of March, 1992

*Attest:*

HARRY F. MANBECK, JR.

*Attesting Officer*

*Commissioner of Patents and Trademarks*